United States Patent [19]

Effendi

[11] Patent Number: 4,958,728

[45] Date of Patent: Sep. 25, 1990

[54] FILING SYSTEM

[76] Inventor: Darwin Effendi, 8605 Saffron Place, Burnaby, B.C., Canada, V5A 4H8

[21] Appl. No.: 415,606

[22] Filed: Oct. 2, 1989

[51] Int. Cl.[5] ..... B65D 5/44

[52] U.S. Cl. ..... 206/44 B; 206/425; 229/1.5 R; 312/183

[58] Field of Search ..... 206/44 B, 44 R, 311, 206/425, 600; 220/22.1, 410; 229/1.5 R, 23 R; 312/183, 184

[56] References Cited

U.S. PATENT DOCUMENTS

| | | | |
|---|---|---|---|
| 382,716 | 5/1888 | Matthews | 206/425 |
| 821,019 | 5/1906 | Cooke, Jr. | 206/425 |
| 1,067,531 | 7/1913 | MacGregor . | |
| 1,317,265 | 9/1919 | Bushnell | 40/359 |
| 1,562,487 | 11/1925 | Anthony . | |
| 1,595,761 | 8/1926 | Doughty | 206/425 |
| 1,975,662 | 10/1934 | Rand | 129/16.8 |
| 3,849,922 | 11/1974 | Sahlin | 40/641 |
| 4,053,057 | 10/1977 | Snowden | 40/211 |
| 4,232,596 | 11/1980 | Kroll et al. | 312/184 |
| 4,262,838 | 4/1981 | Mackenzie | 229/72 |
| 4,273,397 | 6/1981 | Nolan | 312/237 |
| 4,405,077 | 9/1983 | Kupersmit | 229/41 |
| 4,444,314 | 4/1984 | Jacobsson | 206/425 |
| 4,538,730 | 9/1985 | Wu | 206/425 |
| 4,765,490 | 8/1988 | Hanson | 211/46 |
| 4,817,861 | 4/1989 | Henrikson | 206/425 |

FOREIGN PATENT DOCUMENTS 426225 3/1935 United Kingdom .

*Primary Examiner*—Jimmy G. Foster
*Attorney, Agent, or Firm*—Shlesinger & Myers

[57] ABSTRACT

An apparatus for filing documents including a box-like container. There is a cover for the container which removably closes the top opening thereof. An expandable file folder has a plurality of divisions and is of a size which fully occupies the interior of the container and extends from one end of the container to another end thereof when expanded. There are mutually engagable tabs and slots or the like for releasably connecting the file folder to the ends of the container to maintain the folder in the expanded condition within the container. Preferrably the bottom of the container has four portions formed by extensions of the sides and ends. The ends of the container may be foldable along vertical center lines thereof. In the knocked-down condition the sides are folded inwardly along the center line and the portions of the bottom are folded upwardly and inwardly between the ends and sides of the container. Preferably the folded container and collapsed folder are removably received within the cover.

16 Claims, 6 Drawing Sheets

FILING SYSTEM

BACKGROUND OF THE INVENTION

This invention relates to a filing system employing a storage container with an expandable, multi-pocket file folder contained therein for systematic filing and storage of document and the like.

Many systems have been devised for the systematic storage of documents. Perhaps the best known system includes filing cabinets, usually of steel, with vertically arranged drawers. Each drawer contains a plurality of file folders which have indexing tabs to identify the contents. Other filing cabinets employ hanging files which are suspended between a pair of parallel rails by relatively stiff members at the upper ends of the folders.

Such storage systems are not economical for many purposes such as businesses operating out of homes, new businesses with limited resources or for the storage of documents which will be referred to infrequently.

The need for a more economical storage system for files and documents has lead to the development and marketing of special storage containers for file folders. These are, in essence, corrugated cardboard boxes. However, they have a size especially adapted for receiving file folders and are typically of rugged construction to withstand handling when full of relatively heavy documents. Files are typically transferred to such containers from filing cabinets when, for example, they are closed and then sent to a remove storage location.

While such containers have been widely accepted, they are not a self-contained filing system by themselves. They typically require a plurality of separate file folders inside to index document storage. As well, these containers are almost invariably sold in a knocked-down condition and sometimes are difficult to assemble.

Filing cases with removable, expanding files have been developed in the past as seen, for example, in U.S. Pat. No. 4,273,397 to Nolan. However, Nolan does not provide a removable top for the filing case so that the expanding file can be accessed without removing it from the filing case. Furthermore, Nolan does not include means for holding the expanding file is the fully expanded condition such that the documents can be readily placed in each separate pockets thereof.

SUMMARY OF THE INVENTION

One aspect of the invention provides a foldable container with two rectangular sides and two rectangular ends. The ends are connected to the sides along foldable corners of the container. There is a rectangular bottom which is formed by extensions of the sides and ends which are foldably connected thereto. The extensions of each end are connected to the extension of a single said side by a hinged connection along a diagonal extending from a corner of the bottom. The extensions of the sides releasably engage each other when the container is unfolded.

The invention also provides an apparatus for filing documents including a box-like container having opposite sides, opposite ends, an open top and a bottom. There is a cover for the container which removably closes the open top. An expandable file folder has a plurality of pockets and is of a size which fully occupies the interior of the container and extends from one end thereof to another end thereof when expanded. The file folder is releasably connected to the ends of the container to maintain the folder expanded.

The invention provides several advantages compared with the prior art. For example, the container can be conveniently knocked down for sale or for temporary storage when empty, yet is easily unfolded and assembled for use. This is facilitated by the configuration of the bottom which may automatically lock in place when the sides and ends are unfolded.

When unfolded and assembled for use, the invention provides a filing system which allows easy storage for documents in a systematic manner. The cover of the container is simply removed and the expandable file is held open inside the container. Indicia can easily be placed on the individual pockets of the folder to indicate the correct location for documents by alphabet, number, date or the like. Alternatively, the expandable folders can be utilized outside the container until they are full. They can then be placed inside the container where they are held securely in the expanded condition so they can be moved or stored without spilling the contents once the cover is placed on the container.

DESCRIPTION OF THE PREFERRED EMBODIMENTS

Figure 1:
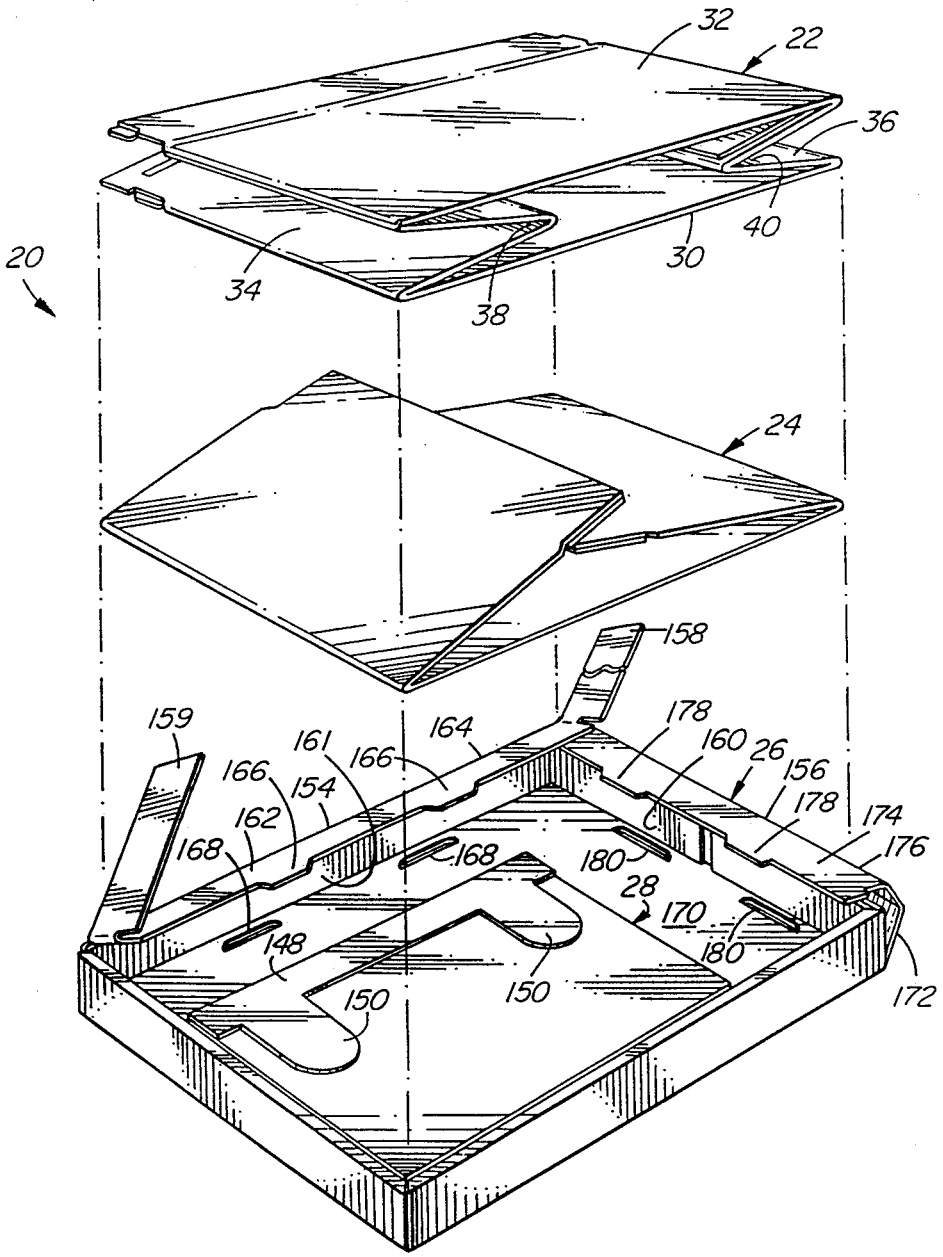
FIG. 1 is an exploded view of an apparatus for filing documents according to an embodiment of the invention shown in a knocked-down condition suitable for sale or storage when empty, the cover being shown partly disassembled and partly broken away.

Referring firstly to FIG. 1, this shows an apparatus 20 suitable for filing documents when unfolded and assembled as described below. The apparatus includes four major components, namely a container 22, an inside liner 24 for the container, a cover 26 for the container, shown partly unfolded, and an expandable file folder 28 shown inside of the cover where it may be stored when not in use. The container and liner are shown slightly unfolded and removed from the cover for clarity, but both the container and liner are sized to fit within the cover.

Referring firstly to the container 22, this is essentially a cardboard box, but one which is easily folded for storage inside the cover 26 and yet can be easily unfolded and assembled for use. The container 22 has two opposite, rectangular sides 30 and 32 and two opposite, rectangular ends 34 and 36. The ends are foldable along their centre lines 38 and 40 respectively, these centre lines being vertical when the container is assembled and positioned for use.

Figure 3:
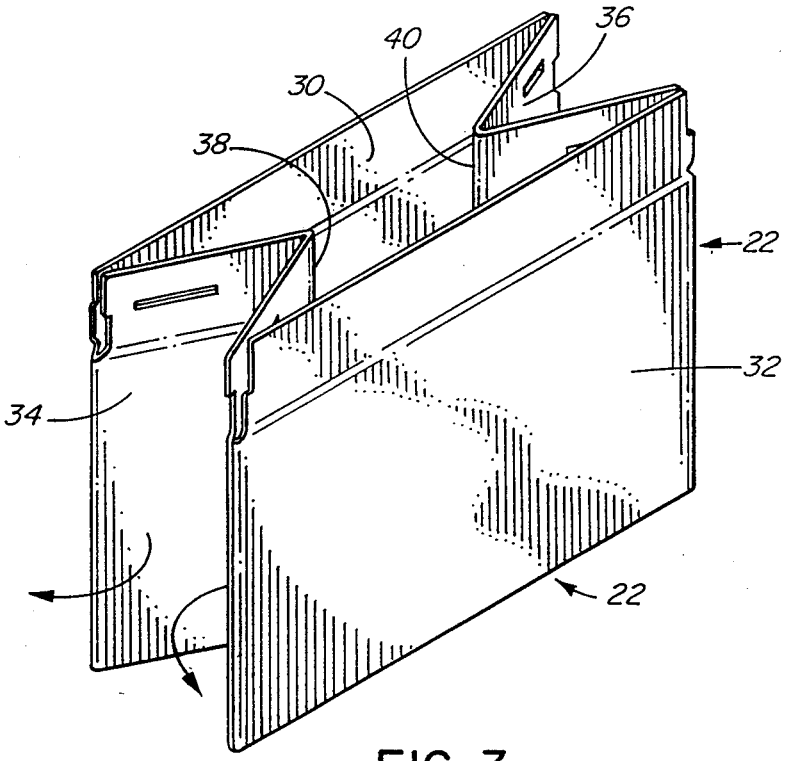
FIG. 3 is a simplified, isometric view of the container of the apparatus of FIG. 1 shown partially unfolded.
Figure 7:
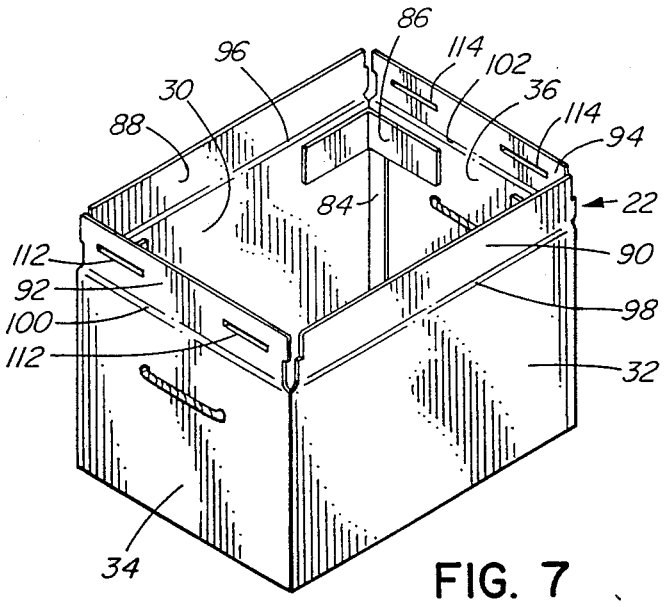
FIG. 7 is a simplified, isometric view of the container with the sides unfolded.

As seen in FIG. 3, the container is unfolded by moving the sides 30 and 32 apart and unfolding the ends 34 and 36 about their centre lines 38 and 40. FIG. 7 shows the container when the ends are fully unfolded.

Figure 5:
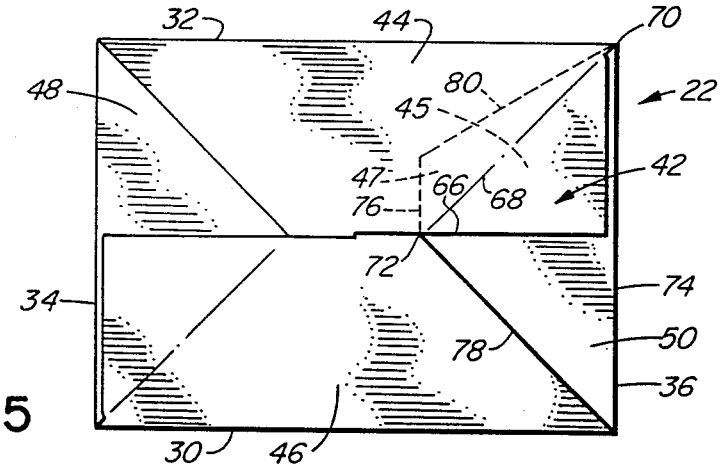
FIG. 5 is a bottom plan of the container shown unfolded and ready for use.
Figure 6:
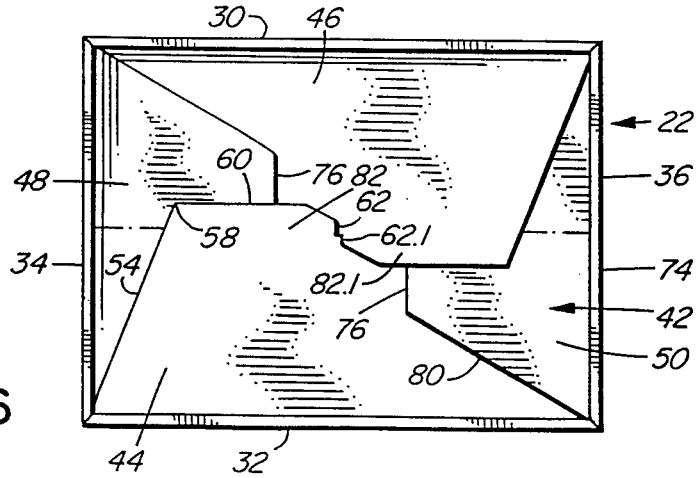
FIG. 6 is a top plan view of the container, with the top and liner removed, showing the container unfolded and assembled.

The container 22 has a bottom 42 shown in the fully unfolded and assembled condition in FIG. 5 and 6 from the outside and inside of the container respectively. The bottom 42 is comprised of four portions 44, 46, 48 and 50. Portions 44 and 46 are extensions of the sides 30 and 32, while portions 48 and 50 are extensions of the ends 34 and 36. The extensions are hingedly connected to the respective sides and ends by folds extending along the bottom edges of the container.

Figure 4:
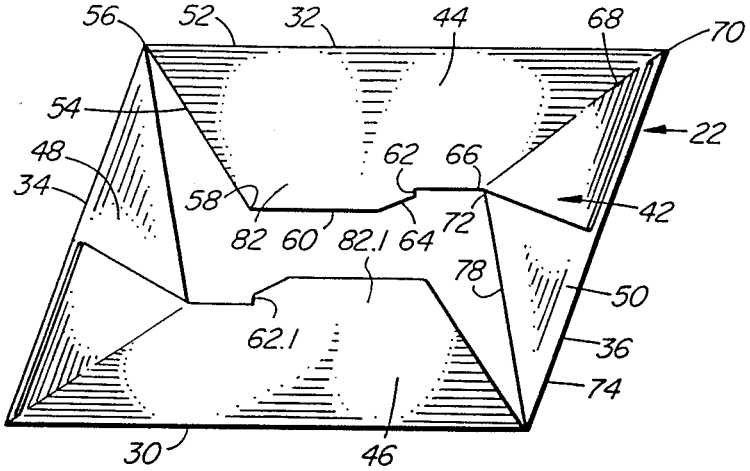
FIG. 4 is a bottom plan of the container of FIG. 1 shown folded slightly from its assembled condition.

Extension 44 is a single piece of cardboard extending from end 34 to end 36 of the container as best seen in FIG. 4. It has an outer edge 52 where it is hingedly connected to side 32 and an edge 54 extending at an acute angle from corner 56. The opposite end of edge 54 forms a corner 58 with a straight edge 60 which is parallel to edge 52 and side 32. There is a short straight edge 62 extending perpendicular to edge 52 and side 32. A beveled edge 64 joins edges 60 and 62. An edge 66 extends from edge 62 to the middle of end 36 of the container. Edge 66 is straight when the container is fully unfolded as shown in FIG. 5. There is a diagonal fold 68 extending from corner 70 of the container to a point 72 along edge 66. Extension 44 is folded inwardly along this fold 68 in FIG. 4 and thus edge 66 does not appear straight in that view. Extension 46 is the same as extension 44 and thus is not described in detail.

Extension 50 is a single piece of cardboard in this embodiment which is integral with end 36. Its edge 74 extends along the fold at the bottom of end 36. Edge 76, shown in FIG. 6 and in broken lines in FIG. 5, is parallel to edge 74, but is considerably shorter. Thus, extension 50 is trapezoidal in shape with non-parallel edges 78 and 80 best shown together in FIG. 5. Fold 68 forms a hinged connection between extension 50 and extension 44 of side 32. It will be observed that there is no permanent connection between extension 50 and extension 46 of side 30 or between extension 44 and extension 48 of end 34.

A co-extensive triangular portion 45 of extensions 44 and 50 is bounded by fold 68, edge 66 of extension 44 and edge 74 of extension 50 as seen best in FIG. 5. Extension 44 and extension 50 are securely bonded together in this area by an adhesive. There is a triangular area 47 of extension 50 which overlies extension 44 inside the container. The area 47 is bounded by edges 76 and 80 and fold 68. There is no adhesive used between the two extensions in this area. Consequently, when extension 44 folds inwardly along fold 68 as shown in FIG. 4, extension 50 remains flat and the triangular portion just mentioned folds inwardly against the inside of end 36 with the rest of the extension.

Extension 48 bears the same relationship to extension 46 as extension 50 does to extension 44. Extension 48 is identical to extension 50 and therefore will not be described in full detail.

The four portions of bottom 42 comprising extensions 44, 46, 48 and 50 interlock to form a solid bottom when the sides and ends are moved from the slightly folded position shown in FIG. 4 to the unfolded, rectangular shape shown in FIG. 5. Extension 44 has a flap 82 bounded by edges 62, 64, 60 and a portion of edge 54 adjacent corner 58 as seen in FIG. 4. When the bottom is fully assembled, this flap 82 moves inside the container to overlie portions of extension 48 and extension 46 as seen best in FIG. 6. There is a similar flap 82.1 on extension 46 which similarly overlies portions of extension 50 and extension 44. Extension 46 has an edge 62.1 equivalent to edge 62 of extension 44. These edges oppose each other and serve as means releasably engaging extensions 44 and 46 of the sides when the container is fully unfolded as seen in FIG. 6.

The two ends 34 and 36 and sides 30 and 32 of the container together with the extensions thereof are formed from a two pieces of corrugated cardboard in the preferred embodiment. The sheets of cardboard are folded and joined together along flap 84 at diagonally opposite corners of the container, one such flap being shown in FIG. 7. Reinforcing strips 86 are secured to each corner adjacent the top thereof by adhesive to strengthen the structure in this example.

Figure 9:
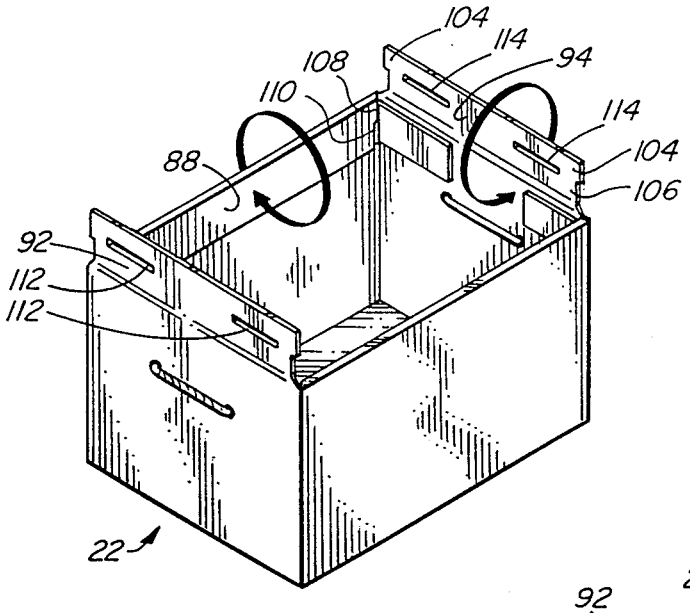
FIG. 9 is a simplified, isometric view showing the top flaps of the sides and ends of the container in the process of being folded inwardly.

It may be observed in FIG. 7 that sides 30 and 32 and ends 34 and 36 have flaps 88, 90, 92 and 94 respectively at the tops thereof which are extensions of the sides and ends and are joined thereto along folds 96, 98, 100 and 102 respectively. The end flaps 92 and 94 have outwardly projecting tabs 104 on the outer portion at each end as seen in FIG. 9 for flap 94. There are recesses 106 located inwardly from the tabs. The flaps for the sides also have tabs 108, but they are located inwardly and recesses 110 are located at each end of the side flaps outwardly from the tabs.

End flaps 92 and 94 have a pair of spaced-apart slots 112 and 114 respectively extending therethrough. These slots are horizontal when the container rests on a surface for normal use.

Figure 8:
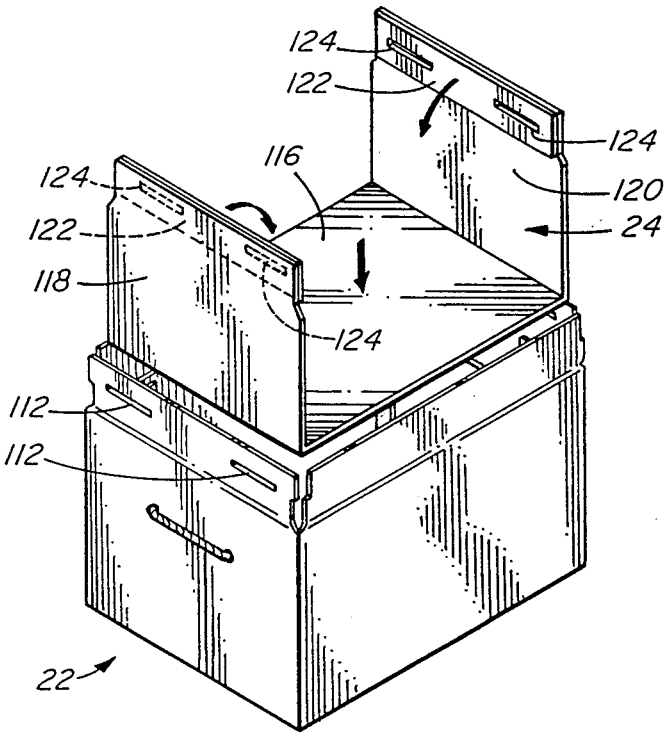
FIG. 8 is a simplified, isometric view showing the liner being inserted in the container.

Referring to FIGS. 1 and 8, liner 24 is U-shaped when unfolded as seen in the latter figure. It has a bottom 116 and two ends 118 and 120 formed from a single piece of corrugated cardboard in this example. The upper portion of each end is reinforced by a rectangular thereof by adhesive. Each of these pieces of cardboard is provided with a pair of slots 124 corresponding in shape and spacing to the slots 112 and 114 of the flaps 92 and 94.

During assembly of the container, the liner 24 is inserted into the container as shown in FIG. 8 after the sides and bottom are unfolded. The liner is pushed to the bottom of the container until its bottom 116 is pressed against the inside of bottom 42. After the liner is inserted, flaps 88 and 90 are folded inwardly, followed by flaps 92 and 94 as shown in FIG. 9. The tabs 104 and 108 and recesses 110 and 106 of the flaps interlock and hold the flaps securely inside the upper edge of the container.

Figure 2:
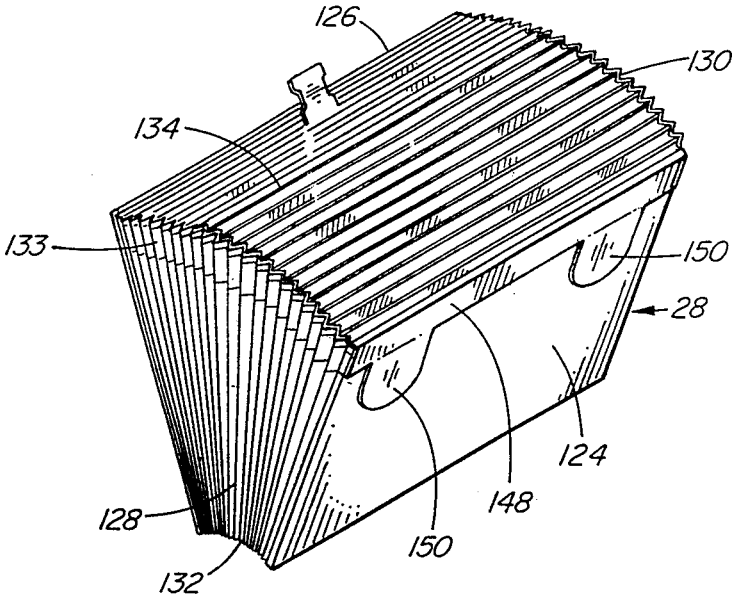
FIG. 2 is a perspective view of the expandable file folder of the apparatus of FIG. 1.

FIG. 2 shows the expandable folder 28 removed from the cover shown in FIG. 1. The folder is generally conventional and includes relatively thick, rigid rectangular end panels 124 and 126 which are connected together by pleated sides 128 and 130 and a pleated bottom 132. A length of plastic adhesive tape 133 is secured along the each side near the top thereof to strengthen the sides. Rectangular dividers 134 divide the folder into a plurality of pockets and are connected by adhesive along the pleats of the sides.

Figure 15:
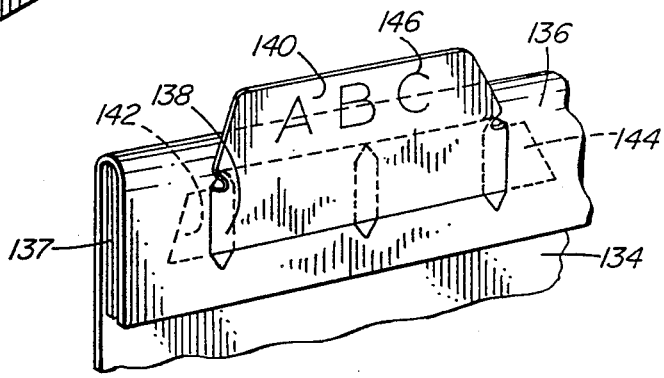
FIG. 15 is a fragmentary elevation of the top of one divider of the file folder showing a removable indexing tab located thereon.

Referring to FIG. 15, each divider 134 has a folded portion 136 extending along the top thereof and secured by adhesive. The front of the folded portion is reinforced by a length of plastic adhesive tape 137 secured along the inside of the folded portion. A plurality of vertical slots 138 are spaced-apart along this front of the folded portion with about one inch spacing. Optionally, a plastic tab 140 can be inserted into a pair of these slots by means of its pointed ends 142 and 144. The tab is formed by a folded piece of clear plastic and may contain indexing indicia printed on a piece of paper, for example, received between the two layers of the tab. In this way, each of the pockets in the folder can be labeled to indicate the contents of the particular pocket.

The top of each of the end panels 124 and 126 is doubled over to form a flap 148 cemented in place as seen in FIG. 1 and FIG. 2. Each of these flaps has a pair of downwardly extending tabs such as tabs 150 of end 124.

Figure 10:
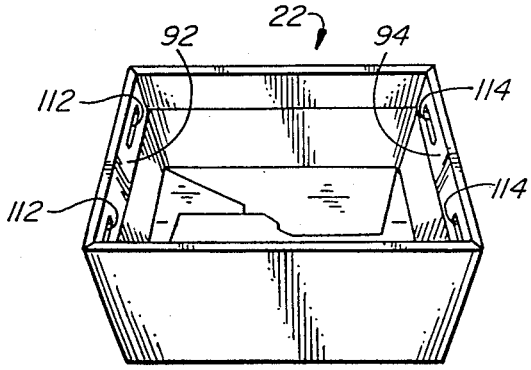
FIG. 10 is a perspective view of the container with the top flaps of the sides and ends folded inwardly and with the liner removed to show the interior of the bottom.
Figure 11:
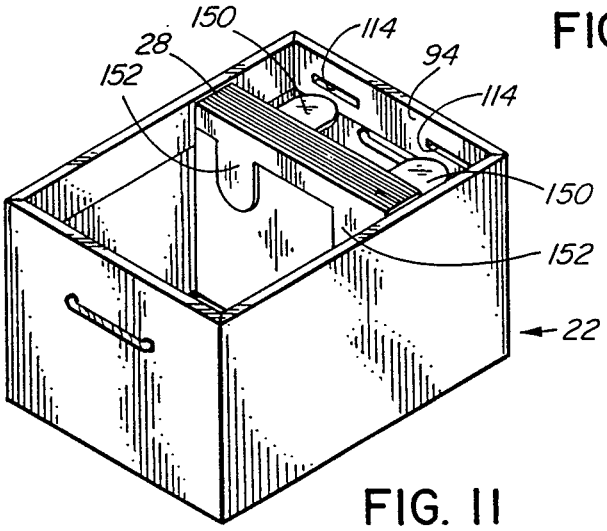
FIG. 11 is a perspective view of the container with the expandable file folder contained therein in the non-expanded condition and showing two of the tabs on the folder approaching slots in one end of the container.

Referring to FIG. 11, these tabs 150 are designed to fit within the slots 114 of flap 94 and then through slots 124 of liner 24 best seen in FIG. 10. Similarly, as seen in FIG. 13 the tabs 152 on the opposite end of the expandable folder fit within the slots 112 of flap 92 and then other set of slots 124 of the liner. After being inserted, both sets of flaps are angled downwardly and pushed towards the bottom of the container so they attain a vertical position between the flaps 92 and 94 and the main portions of the ends 34 and 36 of the container. Thus, referring to FIG. 12 and 13, once inserted, the tabs are not visible.

Figure 14:
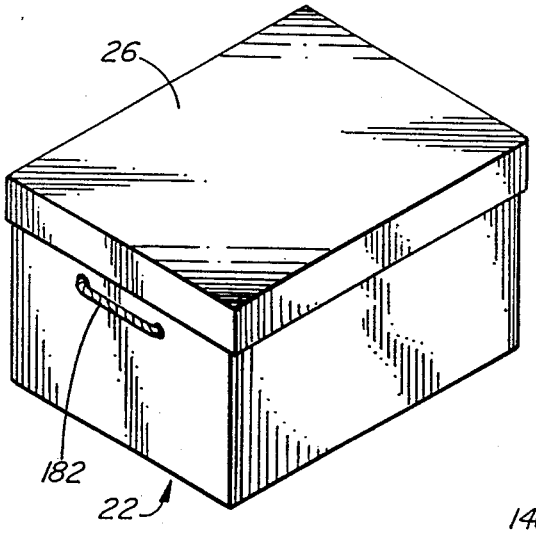
FIG. 14 is a perspective view of the container with the top in place thereon.

Cover 26 removably closes the top opening of the container 22 as shown in FIG. 14. The construction of the cover is best appreciated from FIG. 1. Here one of the sides 154 and one of the ends 156 are shown partly disassembled.

Each side has two elongated tabs at each end, such as tabs 158 and 159, shown partly broken away, and tab 160. The tabs are equal in length to one half the length of each end of the cover. Tab 160 and a similar tab at the opposite end of side 154 (not shown) are connected to outer portion 161 of side 154. Tab 158 and a similar tab 159 at the opposite end extend from flap 162 which is folded along edge 164 of side 154. Flap 162 has a pair of shorter spaced-apart tabs 166 which correspond in size and position to slots 168 in top 170 of the cover. When fully assembled, flap 162 is folded downwardly until tabs 166 enter slots 168. The tabs 158 and 159 then overlie tabs 160 together forming an inner core of the ends.

End 156 has an outer part 172 with a flap 174 connected thereto along fold 176. Flap 174 has spaced-apart tabs 178 which correspond in size and position to the slots 180 in the top 170 of the cover. After flap 162 of side 154 is folded down, flap 174 is folded over tabs 158 and 160 and the corresponding tabs of the opposite side. Tabs 178 are then inserted in slots 180. There is a similar arrangement at the opposite end of the cover.

Figure 12:
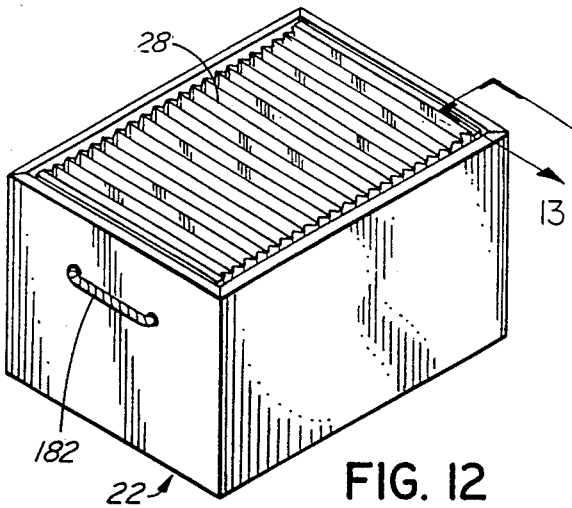
FIG. 12 is a perspective view of the container with expanded folder contained therein.
Figure 13:
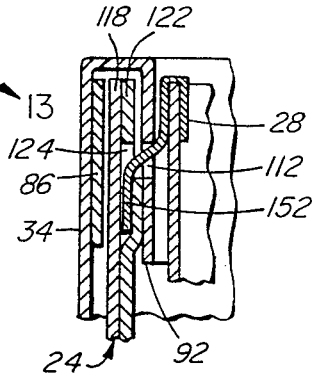
FIG. 13 is a fragmentary section taken along line 13—13 of FIG. 12.

To facilitate moving the container, it is provided with rope handles 182 at each end as shown in FIG. 12 and 14. The rope is inserted through circular apertures in the ends of the container and through similar sized apertures in a strip of thick cardboard located between each end of the container and the liner. The ends of the rope are knotted together. The internal structure is not shown in the drawings.

Changes and modifications in the specifically described embodiments can be carried out without departing from the scope of the invention which is intended to be limited only by the scope of the appended claims.

I claim:

1. An apparatus for filing documents, comprising:

a box-like container having opposite sides, opposite ends, a top opening and a bottom;

a cover for the container which removably closes the said top opening;

an expandable file folder having a plurality of divisions and being of a size which fully occupies the interior of the container and extends from one end of the container to another end thereof when in an expanded condition; and releasably connecting means for releasably connecting the file folder to the ends of the container, the said ends being spaced apart at a fixed distance which is sufficient to maintain the folder in the expanded condition within the container.

2. An apparatus as claimed in claim 1, wherein the connecting means include slots on the ends of the container and tabs on the file folder receivable in said slots.

3. An apparatus as claimed in claim 1, wherein said file folder includes two rectangular end panels, pleated sides and a pleated bottom extending between the end panels, the dividers being rectangular and extending between the pleated sides and bottom to form pockets between the dividers, the connecting means being spaced-apart tabs extending towards the bottom of each said end panel and spaced-apart slots on the inside of each said end of the container for receiving the tabs.

4. An apparatus as claimed in claim 1, wherein the cover is rectangular and has sides and ends, the apparatus having a knocked-down condition wherein the container is folded, the file folder is collapsed and the folded container and collapsed folder are removably received within the cover.

5. An apparatus as claimed in claim 4, wherein the bottom of said container has four portions formed by extensions of the sides and ends and being foldably connected thereto, the ends of the container being foldable along vertical centre lines thereof, in the knocked-down condition the sides being folded inwardly along the centre line and the portions of the bottom being folded upwardly and inwardly between the ends and the sides of the container.

6. An apparatus as claimed in claim 1, in which:

the sides and ends of the container are rectangular, the ends being connected to the sides along foldable corners of the container;

the bottom is rectangular and is formed by extensions of the sides and ends which are foldably connected to said sides and ends, the extension of each end being connected to the extension of a single said side by a hinged connection which falls along a diagonal extending from a corner of the bottom, the extensions of the sides having means for releasably engaging each other when the container is unfolded.

7. A container as claimed in claim 6, wherein, when the container is unfolded, a portion of said extension of each side overlies a portion of said extension of another said side.

8. A container as claimed in claim 7, wherein, when the container is unfolded, said portion of each said side also overlies a portion of the extension of said end which is hingedly connected to said another side.

9. A container as claimed in claim 1, wherein said extensions of said ends have portions which overlie said extensions of the side hingedly connected thereto when the container is unfolded.

10. A container as claimed in claim 1, wherein the means for releasably engaging each other includes interlocking edges of the extensions of the sides opposing each other near the centre of the bottom when the container is unfolded.

11. A container as claimed in claim 1, wherein said ends are foldable along centre lines thereof extending perpendicularly to the bottom of the container when unfolded.

12. A container as claimed in claim 11, wherein the container has a folded condition where the ends are folded along the centre lines so the centre lines are deflected inwardly and the outsides of folded portions of each end are adjacent each other, the extensions of the sides are folded upwardly from the bottom and are adjacent the insides of the ends, the extensions of the sides are folded upwardly from the bottom and are received between the extensions of the ends and the sides, said sides overlaying each other so their perimeters coincide, the folded ends, extensions of the ends and extensions of the sides being foldably received between said sides within said perimeters of the sides.

13. An apparatus for filing documents, comprising:

a box-like container having opposite sides, opposite ends, a top opening and a bottom;

a cover for the container which removably closes the said top opening, the cover being rectangular and having sides and ends; and an expandable file folder having a plurality of divisions and being of a size which fully occupies the interior of the container and extends from one end of the container to another end thereof when expanded;

releasable connecting means for releasably connecting the file folder to the ends of the container to maintain the folder in the expanded condition within the container, and the apparatus having a knocked-down condition wherein the container is folded, the file folder is collapsed, and the folded container and collapsed folder are removably received within the cover.

14. An apparatus as claimed in claim 13, wherein:

the bottom of said container has four portions formed by extensions of the sides and ends and being foldably connected thereto, the ends of the container being foldable along vertical centre lines thereof, and in the knocked-down condition the sides being folded inwardly along the respective centre lines and the portions of the bottom being folded upwardly and inwardly between the ends and the sides of the container.

15. An apparatus for filing documents, comprising:

a box-like container having opposite sides, opposite ends, a top openings and a bottom;

a cover for the container which removably closes the said top opening;

an expandable file folder having a plurality of divisions and being of a size which fully occupies the interior of the container and extends from one end of the container to another end thereof when expanded; and releasable connecting means for releasably connecting the file folder to the ends of the container to maintain the folder in the expanded condition within the container;

the releasable connecting means including each end of the container having at least one elongated horizontal slot located adjacent an upper portion of the respective end, and the expandable file folder has a rectangular end panel at each end thereof, the end panel having at least one elongated downwardly extending tab located adjacent an upper portion thereof and adapted to fit within the elongated slot.

16. An apparatus as claimed in claim 15, wherein the releasable connecting means includes:

two inwardly horizontal elongated slots disposed adjacent the upper portion of each end of the container, the slots being horizontally aligned with each other and spaced apart adjacent corners of the container;

each end panel of the file folder has a pair of spaced apart, downwardly extending tabs located adjacent upper portions of end panels of the file folder.

* * * * *